US007578777B2

(12) United States Patent
Draghetti et al.

(10) Patent No.: US 7,578,777 B2
(45) Date of Patent: Aug. 25, 2009

(54) EQUIPMENT FOR MANUFACTURING COMPOSITE FILTERS

(75) Inventors: Fiorenzo Draghetti, Medicina (IT); Salvatore Rizzoli, Bologna (IT); Emanuele Giovannini, Casalecchio Di Reno (IT)

(73) Assignee: G.D S.p.A. (IT)

( * ) Notice: Subject to any disclaimer, the term of this patent is extended or adjusted under 35 U.S.C. 154(b) by 255 days.

(21) Appl. No.: 11/384,292

(22) Filed: Mar. 21, 2006

(65) Prior Publication Data

US 2006/0213528 A1 Sep. 28, 2006

(30) Foreign Application Priority Data

Mar. 24, 2005 (IT) ..... BO2005A0184

(51) Int. Cl.
*B31C 99/00* (2009.01)

(52) U.S. Cl. ..... 493/39; 493/4; 493/45; 493/941; 131/88; 131/92; 131/280; 198/471.1; 198/474.1; 198/428

(58) Field of Classification Search ..... 493/4, 493/45, 47, 50, 941, 39; 198/471.1, 474.1, 198/478.1, 428, 432, 459.8; 131/88, 92, 131/94, 280

See application file for complete search history.

(56) References Cited

U.S. PATENT DOCUMENTS 2,912,987 A * 11/1959 Molins et al. ..... 131/94
2,957,285 A * 10/1960 Molins ..... 493/47
3,009,557 A * 11/1961 Jackson ..... 198/433
3,131,612 A * 5/1964 Rowlands ..... 493/45
3,267,821 A 8/1966 Rowlands
3,567,011 A * 3/1971 Pinkham ..... 198/471.1
3,952,865 A * 4/1976 Rudszinat et al. ..... 198/377.04
4,044,659 A 8/1977 Bardenhagen
4,185,941 A * 1/1980 Molins et al. ..... 406/77
4,238,994 A * 12/1980 Koch ..... 493/4
4,244,250 A * 1/1981 Rudszinat ..... 83/310
4,287,979 A 9/1981 Molins
6,648,122 B1 * 11/2003 Hirsch et al. ..... 198/377.08
7,165,668 B2 * 1/2007 Dombek ..... 198/459.8
2004/0237972 A1 12/2004 Horn
2005/0077149 A1 * 4/2005 Wohltmann ..... 198/475.1

FOREIGN PATENT DOCUMENTS

EP 0383970 8/1990
EP 0452906 10/1991

* cited by examiner

*Primary Examiner*—Hemant M Desai
(74) *Attorney, Agent, or Firm*—Timothy J. Klima

(57) ABSTRACT

Filter elements made up of least two axially aligned plugs are advanced in succession by a feed unit along a first path and in a first direction, with the plugs oriented along a second direction transverse to the first direction, toward a garniture section extending along a second horizontal path and in a third direction, on which they are formed into at least one continuous rod which is then divided up by a rotary cutter into single composite filters. A transfer unit linking the feed unit and the garniture section comprises a conveyor, rotatable about a first axis parallel to the second direction, equipped with carriers each presenting at least one slot designed to admit one filter element; the single carriers are pivotable independently relative to the conveyor about a second axis parallel to the first axis, and about a third axis transverse to the first axis, alternating between positions in which the slot extends parallel with the second direction and with the third direction.

20 Claims, 4 Drawing Sheets

EQUIPMENT FOR MANUFACTURING COMPOSITE FILTERS

BACKGROUND OF THE INVENTION

The present invention relates to equipment for the manufacture of composite filters.

Conventionally, the harmful effects of inhaling cigarette smoke are reduced by tipping cigarettes with composite filters, that is to say with filters obtainable by pairing together two or more filter plugs made of material having different filtration characteristics.

In the case of composite filters incorporating two filter plugs, for example, these are prepared employing machines in which first and second plugs dispensed from separate reservoirs are transferred along a direction transverse to their longitudinal axes, by respective trains of fluted rollers, onto a common take-up roller with peripheral flutes each designed to accommodate two axially aligned plugs making up a single filter element.

These composite elements are then transferred by rotary transfer means to a garniture section and formed into a filter rod.

Passing singly and in succession through the garniture section, the filter elements advance in end-to-end contact along a direction parallel with their longitudinal axes and are wrapped in a strip of paper material to form a continuous filter rod that will be divided up subsequently into single composite filters by a rotary cutter operating at the outfeed end of the garniture section.

In equipment of this prior art type, as described and illustrated in U.S. Pat. No. 4,044,659 for example, the garniture section is set at right angles to the feed direction followed by the filter elements along the rotary transfer means and on the common take-up roller.

With the two portions of the composite filter production line aligned on directions extending transversely one to another, an architecture of this type betrays drawbacks in terms both of its inordinately large proportions, particularly where systems may incorporate more than one line, and of the difficulty experienced by a single operator in supervising the various steps of the process.

The prior art also embraces production lines in which the garniture section extends substantially in alignment with the feed direction followed by the filter elements along the transfer means aforementioned.

The rotary transfer means in such lines comprise a first frustoconical roller by which the filters are received from the common take-up roller, turned through 90° about a vertical axis, and transferred to a further roller of which the function is to direct the composite filters onto the garniture section.

An arrangement of this type overcomes the problem of alignment between the rotary transfer means and the garniture section, thereby facilitating visual supervision of the line by an operator, but is cumbersome and lacking in speed.

The object of the present invention is to provide equipment of compact dimensions for assembling and feeding composite filters, from which the drawbacks described above will be absent.

SUMMARY OF THE INVENTION

The stated object is realized according to the present invention in equipment for manufacturing composite filters that comprises conveyor means, by which filter elements are directed in succession along a first path and in a first feed direction transverse to the longitudinal axis of the single filter element, and a garniture section on which the filter elements are formed into at least one continuous rod, extending along a second path and in a third feed direction followed longitudinally by the filter elements.

Also forming part of the equipment is a unit incorporating a conveyor rotatable about a first axis transverse to the third direction, by which the filter elements are transferred from the conveyor means to the garniture section.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
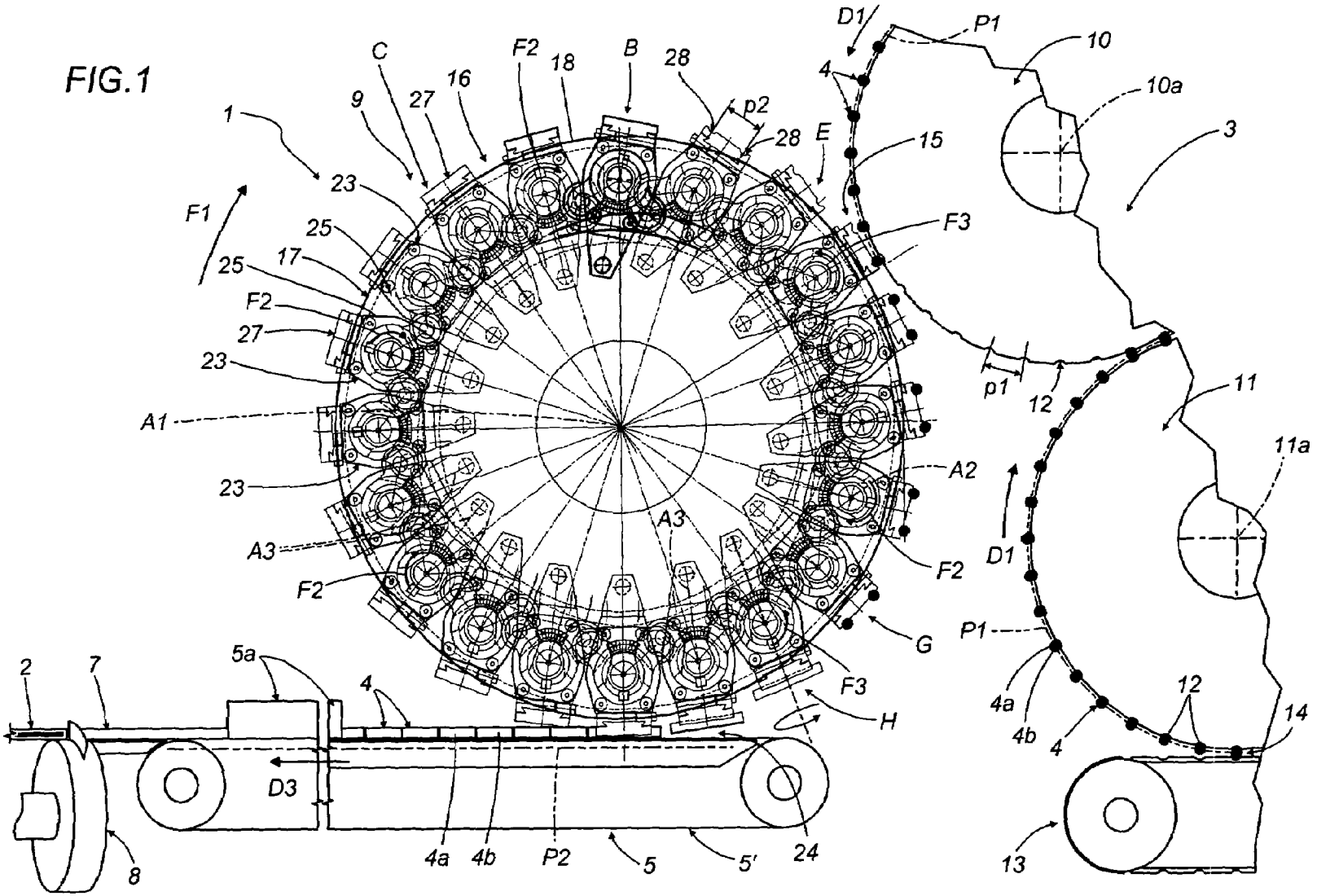
FIG. 1 illustrates a portion of equipment for manufacturing composite filters according to the present invention, viewed schematically in a front elevation.

With reference to the drawings, FIG. 1 shows a final or outfeed portion of equipment 1 for the manufacture of composite filters 2, embodied in accordance with the present invention.

The equipment 1 comprises a feed unit 3 with conveyor means by which filter elements 4 are directed along a first feed path P1 extending in a first direction D1, denoted schematically by arrows which also indicate the sense of rotation.

Each filter element 4 is composed of at least two cylindrical plugs 4*a* and 4*b* aligned axially along a second direction D2 transverse to the first direction D1 and placed in end-to-end contact.

Figure 4:
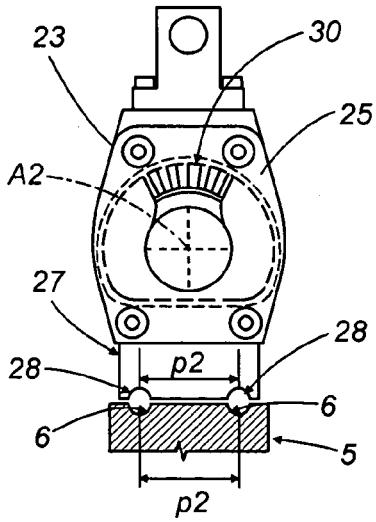
FIG. 4 is a detail of FIGS. 1 to 3, viewed schematically in a front elevation.
Figure 2:
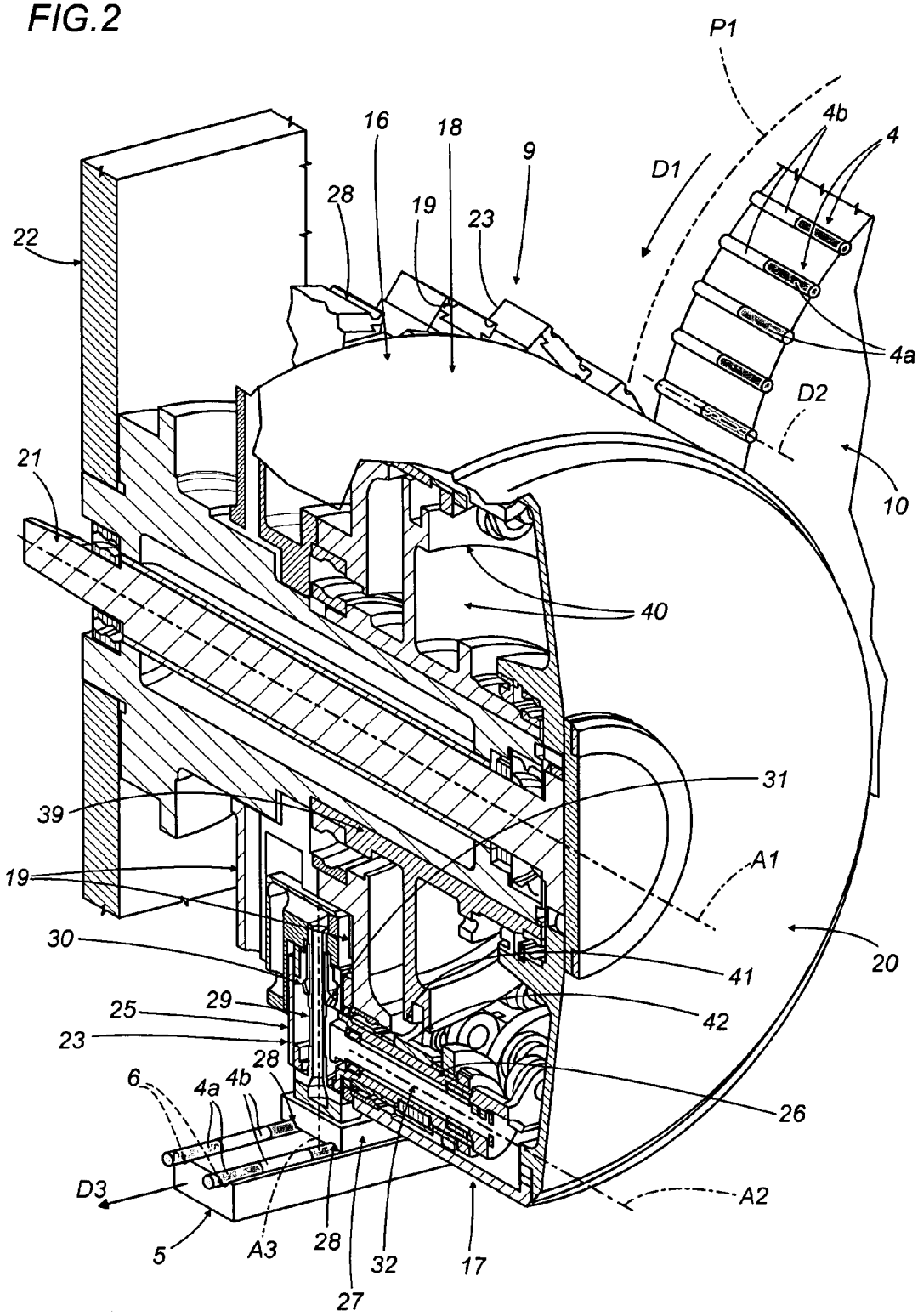
FIG. 2 is a detail of FIG. 1, illustrated schematically and in perspective with certain parts cut away and others shown in section for clarity.
Figure 3:
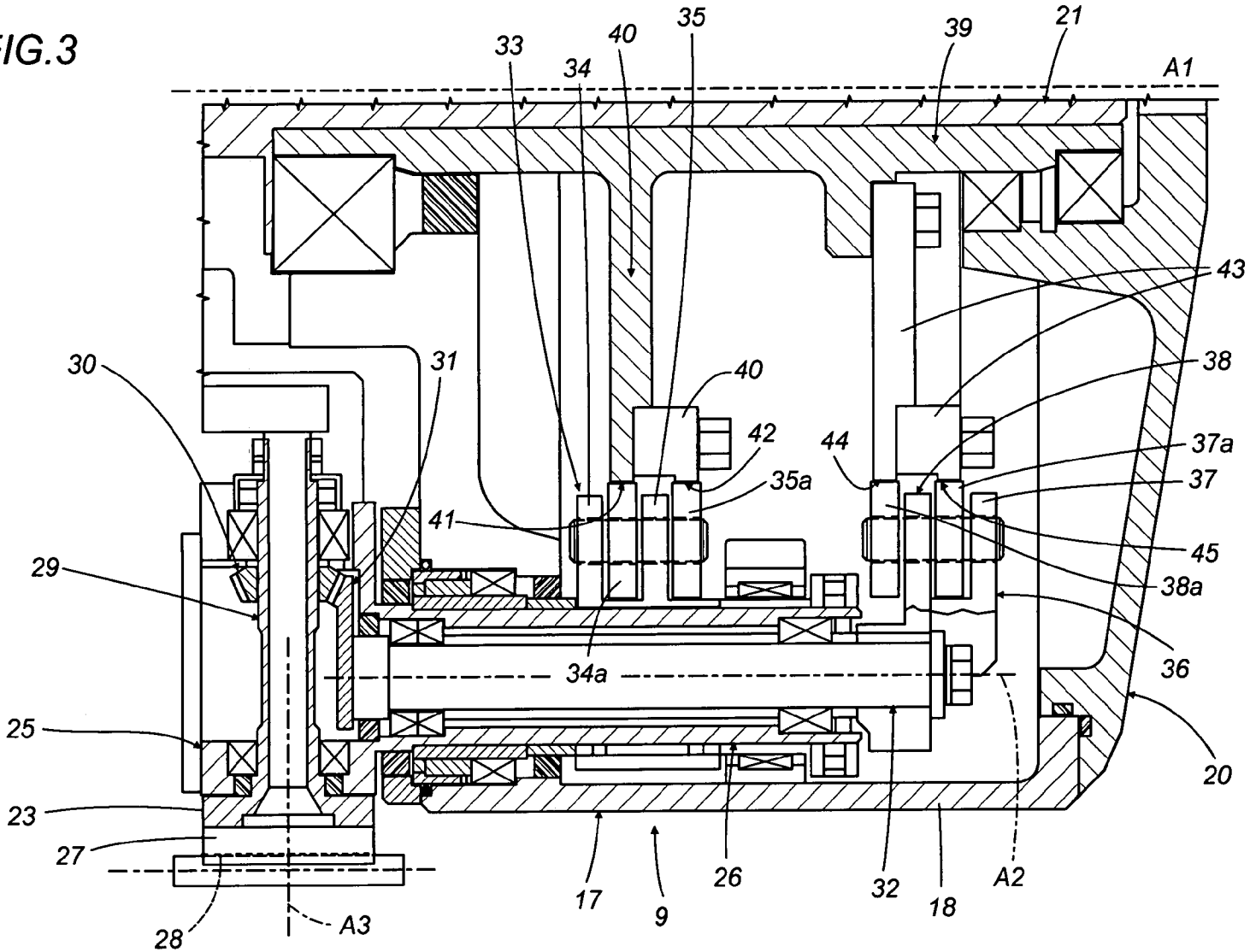
FIG. 3 is a detail of FIG. 2, illustrated schematically in a side elevation with certain parts cut away and others shown in section for clarity.

Referring to FIGS. 1, 2 and 4, the equipment 1 comprises a garniture section 5 with two parallel channels 6, each occupied slidably by a respective tape 5', along which two continuous filter rods 7 are formed (one rod only is visible in FIG. 1).

More exactly, two continuous successions of filter elements 4 are advanced along the garniture section 5 following a third direction D3 orthogonal to the aforementioned second direction D2, and enveloped progressively in respective plug-wrap papers (not illustrated in the drawings) by a garniture unit shown schematically as a block 5*a*, so as to form the two continuous rods 7; the rods are then fed through a single rotating cutter 8 at the outfeed end of the garniture section 5 and divided up into single composite filters 2, each composed of two respective plugs 4*a* and 4*b*.

Also forming part of the equipment 1 is a unit 9 interposed between the feed unit 3 and the garniture section 5, serving to transfer the filter elements 4 from the former to the latter.

In the example of FIG. 1, the conveyor means of the feed unit 3 comprise a top roller 10 and a bottom roller 11 substantially tangential one to another, rotating counterclockwise and clockwise respectively about axes 10*a* and 11*a* parallel to the second direction D2.

The two rollers 10 and 11 each present aspirating flutes 12 equispaced around the periphery at a given pitch p1 and serving to accommodate the filter elements 4.

Filter elements 4 fed to the bottom roller 11 from a conveyor belt 13, at an infeed station 14, are released to the transfer unit 9 at a take-up station 15 marking the end of the first path P1 established by the two feed rollers 10 and 11.

The transfer unit 9 consists in a rotary conveyor denoted 16, turning clockwise (see arrow F1) about a first axis A1 parallel to the axes 10*a* and 11*a* of the two feed rollers and comprising a drum 17 that appears as a cylindrical wall 18 enclosed at the two ends by further walls denoted 19 and 20.

As illustrated schematically in FIG. 2, the drum 17 is keyed to the end of a shaft 21 coaxial with the aforementioned first axis A1, projecting from a bulkhead 22 carried by the frame of the equipment 1 and power driven by drive means not illustrated in the drawings.

The end of the drum 17 enclosed by the wall 19 nearer to the bulkhead 22 carries a plurality of angularly equispaced peripheral carriers 23 (twenty in the example illustrated), functioning as means by which to transfer the filter elements 4 from the take-up station 15 to an infeed station 24 of the garniture section 5.

Each carrier 23 comprises a body 25 associated rigidly with one end of a hollow shaft or sleeve 26 located internally of the drum 17 and aligned on a second axis A2 parallel to the first axis A1; the sleeve 26 projects from the drum 17 through the wall 19, by which it is supported rotatably.

The body 25 appears elongated in the direction of a third axis A3 transverse to the second axis A2 and is furnished with a head 27, of which an outer surface affords two aspirating slots 28 disposed mutually parallel and spaced apart by a distance p2 greater than the aforementioned pitch p1, each serving to admit a respective filter element 4.

The head 27 of the carrier 23 is associated with one end of a hollow pivot 29 centered on the third axis A3, mounted rotatably to the inside of the body 25 and coupled by way of a bevel gear pair 30 and 31 to an inner shaft 32 housed coaxially within the sleeve 26. The slots 28 are connected via the hollow center of the pivot 29 to suction means of familiar type, not illustrated.

Figure 1A:
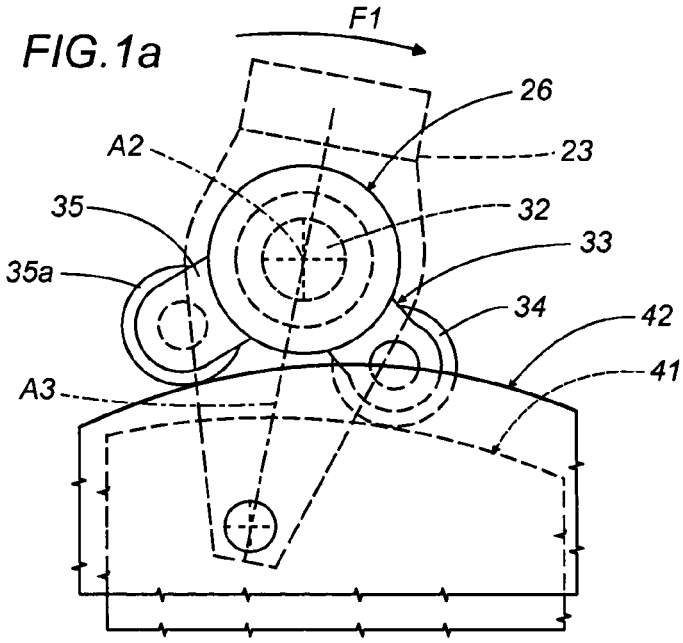
FIGS. 1*a* and 1*b* are enlarged elevation views showing two details of mechanical linkages forming part of the equipment in FIG. 1.
Figure 1B:
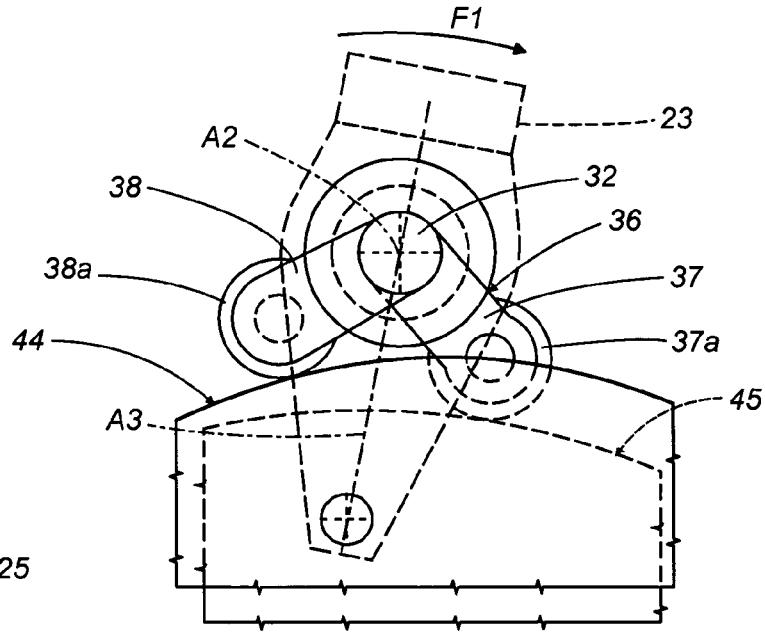

Associated rigidly with the central part of the sleeve 26, as shown to advantage in FIGS. 1*a* and 1*b*, is a first rocker 33 presenting two divergent arms 34 and 35. Associated in turn with the ends of the arms 34 and 35 are respective rollers 34*a* and 35*a* mounted to pins parallel with the first axis A1 aforementioned.

A second rocker 36, illustrated in FIG. 1*b*, is associated rigidly with the free end of the inner shaft 32 projecting from the sleeve 26. Like the first rocker 33, the second rocker 36 comprises two divergent arms 37 and 38 and, associated with the ends of the arms 37 and 38, respective rollers 37*a* and 38*a* mounted to pins parallel with the first axis A1.

Also located inside the drum 17 are a tubular sleeve 39 anchored rigidly to the bulkhead 22, coaxial with the drive shaft 21, and, fixed to the sleeve in an intermediate position, a first pair of discs 40 functioning as two cams of which the profiles, denoted 41 and 42 respectively, are positioned to interact with the rollers 34*a* and 35*a* of the first rocker.

Fixed similarly to an end part of the sleeve 39 is a second pair of discs 43 affording two cams of which the profiles, denoted 44 and 45 respectively, are positioned to interact with the rollers 38*a* and 37*a* of the second rocker.

With the drum 17 in rotation, the first cams 40 interact with the relative pair of rollers 34*a* and 35*a* in such a way as to rock the sleeve 26 and therefore the body 25 of the carrier 23 on the second axis A2 in a manner shortly to be described.

At the same time and in similar fashion, with the drum 17 in rotation, motion is transmitted by the second cams 43 through the respective pair of rollers 37*a* and 38*a*, the inner shaft 32, the bevel gear pair 30 and 31 and the hollow pivot 29 to rotate the head 27 and therefore the slots 28 of the carrier 23 about the third axis A3, in a manner shortly to be described.

In this situation, the first cams 40 combine with the respective rollers 34*a* and 35*a* and the first rocker 33 associated with each carrier 23 to create first actuator means by which the selfsame carrier is made to pivot about the second axis A2.

Similarly, the second cams 43 combine with the relative rollers 37*a* and 38*a*, the second rocker 36 and the bevel gear pair 30 and 31 associated with each carrier 23 to create second actuator means by which the head 27 is made to pivot about the third axis A3.

More particularly, and considering the carrier 23 positioned at the take-up station 15 (FIG. 1), the profiles of the second cams 43 are configured in such a way as to position the head 27 with the slots 28 extending parallel to the first axis A1.

When the top roller 10 and the drum 17 are set in rotation simultaneously, this type of arrangement, as will become clear in due course, allows two filter elements 4 to be transferred in succession from two respective aspirating flutes 12 to the two slots 28 of the carrier 23.

Accordingly, the profiles of the second cams 43 are shaped so that when the drum 17 is in rotation, the head 27, hence the slots 28, will be caused to rotate through 90° during the progress of the carrier 23 in question from a position denoted G to a position denoted H.

In this configuration, the carrier 23 is able to insert the filter elements 4 into the channels 6 of the garniture section 5, which are spaced apart one from the other by the aforementioned distance denoted p2.

The slots 28 remain oriented in this direction through to a position B immediately upstream of the take-up station 15, at which point the profiles of the cams 43 will cause the head 27 to pivot back to its former position so that other filter elements 4 can be taken up from the roller 10.

As regards the operation of the first cams 40 with the drum 17 in rotation, this can be described with reference, for example, to the carrier 23 occupying a position denoted C, that is to say in the course of a step during which the third axis A3 of the carrier 23 in question is disposed radially with respect to the drum 17.

In this situation, the tangential velocity of the head 27 is greater than the tangential velocity of the feed roller 10.

Departing from position C, with the drum 17 in rotation, the carrier 23 turns gradually clockwise (see arrow F2) until brought ultimately into the aforementioned position E immediately upstream of the take-up station 15.

Passing through this same station 15 and during the transfer of two successive filter elements 4, first to the leading slot 28 and then to the trailing slot 28 of the head 27, the carrier 23 is caused to turn in a counterclockwise direction (see arrow F3) about the second axis A2, hence in a direction converse to that of the drum 17.

The effect of this angular motion is to reduce the tangential velocity of the head 27. Thus, at the moment when the filter elements 4 are taken up at the station 15, the tangential velocity of each slot 28 is substantially equal to the tangential velocity of the relative aspirating groove 12.

The counterclockwise rotation F3 continues until the head 27 reaches a substantially intermediate position between the take-up station 15 and the infeed station 24 of the garniture section 5.

Between this intermediate position and the infeed station 24, the carrier 23 in question is caused by the first cams 40 to rock first in a clockwise direction (arrow F2), then in a counterclockwise direction (arrow F3).

In practice, the counterclockwise rocking movement about the second axis A2 is induced during the rotation of the head 27 about the third axis A3 (position G) and as the two filter elements 4 are deposited in the channels 6 of the garniture section 5.

Passing through and beyond the infeed station 24, the carrier 23 in question continues to rotate counterclockwise about the second axis A2 through a given angle.

The counterclockwise rotation is now reversed, and the carrier 23 moves clockwise until brought into a position immediately upstream of the position denoted C, with the relative third axis A3 disposed radially to the drum 17.

It will be seen that the relative rotation of the carriers 23 about the second axes A2 between the positions denoted G and H is instrumental in allowing the head 27 to pivot through 90° while avoiding contact between the ends of the filter elements 4 located in the slots 28 of two adjacent heads 27.

Moreover, the tangential velocity of the heads 27 at the infeed of the garniture section 5 will be marginally greater than the linear feed rate of the garniture tapes 5', so that the two continuous successions of alternating plugs 4*a* and 4*b* can be formed with the respective ends of the plugs in close contact one with the next.

As discernible from the foregoing, accordingly, the transfer unit 9 functions as a mechanism by which the speed and spacing of filter elements 4 supplied by the feed unit 3 can be adapted to the speed and spacing of filter elements 4 advancing in two parallel and continuous successions along the garniture section 5.

What is claimed:

1. Equipment for manufacturing composite filters, comprising:

a first conveyor by which filter elements are directed in succession along a first predetermined path and in a first feed direction transverse to the longitudinal axis of the single filter element;

a garniture section on which the filter elements are formed into at least one continuous rod, extending along a second predetermined path and in a third feed direction followed longitudinally by the filter elements;

a unit comprising a rotary conveyor rotatable about a first axis transverse to the third direction, by which the filter elements are transferred from the first conveyor to the garniture section; the rotary conveyor comprising a drum having a plurality of angularly equispaced peripheral carriers for transferring the filter elements, each able to rock on a respective second axis parallel to the first axis, and including at least one slot for accommodating at least one filter element; and at least one first actuator mechanism having a cam and a cam follower mechanism cooperative with the cam for pivoting each carrier about the second axis, the cam follower mechanism comprising a first rocker having a centrally positioned pivot and two arms extending therefrom, each arm including a roller mounted thereon spaced outwardly from the centrally positioned pivot, each roller engaging a cam profile of the cam to pivot the first rocker and the carrier during relative movement between the rollers and the cam.

2. Equipment as in claim 1, wherein the slot is pivotable relative to the drum about a third axis transverse to the second axis, between a position of parallel alignment with the second direction and a position of parallel alignment with the third direction.

3. Equipment as in claim 1, wherein the second direction and the third direction are mutually orthogonal.

4. Equipment as in claim 1, wherein the slot is provided on a head pivotable about a third axis perpendicular to the second axis.

5. Equipment as in claim 4, wherein the head includes two mutually parallel slots spaced apart one from another by a predetermined distance, and the garniture section includes two channels spaced apart one from another by a predetermined distance.

6. Equipment as in claim 1, comprising a second actuator mechanism by which the slot is caused to pivot about a third axis.

7. Equipment as in claim 6, wherein the second actuator mechanism comprises a hollow pivot rotatable about the third axis, and a bevel gear pair by which rotary motion is transmitted to the hollow pivot.

8. Equipment as in claim 7, wherein the second actuator mechanism comprises a second cam and a second cam follower mechanism cooperative with the second cam.

9. Equipment as in claim 8, wherein the second cam follower mechanism includes a rocker, and two rollers located at respective ends of the rocker.

10. Equipment as in claim 1, wherein the cam includes two cam profiles and each roller engages a separate one of the cam profiles.

11. Equipment for manufacturing composite filters, comprising:

a first conveyor by which filter elements are directed in succession along a first predetermined feed path and in a first direction, each element having a plurality of filter plugs aligned axially along a second direction transverse to the first direction;

a garniture section on which the filter elements are formed into at least one continuous rod, extending along a second horizontal path and in a third direction;

a rotary cutter device by which the rod is divided up into single composite filters;

a unit comprising a rotary conveyor rotatable about a first axis substantially parallel to the second direction, by which the filter elements are transferred from the conveyor means to the garniture section; the rotary conveyor comprising a drum having a plurality of angularly equispaced peripheral carriers for transferring the filter elements, each able to rock on a respective second axis parallel to the first axis, and including at least one slot for accommodating one filter element; and at least one first actuator mechanism having a cam and a cam follower mechanism cooperative with the cam for pivoting each carrier about the second axis, the cam follower mechanism comprising a first rocker having a centrally positioned pivot and two arms extending therefrom, each arm including a roller mounted thereon spaced outwardly from the centrally positioned pivot, each roller engaging a cam profile of the cam to pivot the first rocker and the carrier during relative movement between the rollers and the cam.

12. Equipment as in claim 11, wherein the slot is pivotable relative to the drum about a third axis transverse to the second axis, between a position of parallel alignment with the second direction and a position of parallel alignment with the third direction.

13. Equipment as in claim 11, wherein the second direction and the third direction are mutually orthogonal.

14. Equipment as in claim 11, wherein the cam includes two cam profiles and each roller engages a separate one of the cam profiles.

15. Equipment as in claim 11, wherein the slot is provided on a head pivotable about a third axis perpendicular to the second axis.

16. Equipment as in claim 15, wherein the bead includes two mutually parallel slots spaced apart one from another by a predetermined distance, and the garniture section includes two channels spaced apart one from another by a predetermined distance.

17. Equipment as in claim 11, comprising a second actuator mechanism by which the slot is caused to pivot about a third axis.

18. Equipment as in claim 17, wherein the second actuator mechanism comprises a hollow pivot rotatable about the third axis, and a bevel gear pair by which rotary motion is transmitted to the hollow pivot.

19. Equipment as in claim 18, wherein the second actuator mechanism comprises a second cam and a second cam follower mechanism cooperative with the second cam.

20. Equipment as in claim 19, wherein the second cam follower mechanism includes a rocker, and two rollers located at respective ends of the rocker.

* * * * *